US007143793B2

(12) United States Patent
Vaughn, Jr.

(10) Patent No.: US 7,143,793 B2
(45) Date of Patent: Dec. 5, 2006

(54) CLEANING SYSTEM FOR A FILLING MACHINE

(75) Inventor: Clifford E. Vaughn, Jr., Rock Hill, SC (US)

(73) Assignee: JohnsonDiversey, Inc., Sturtevant, WI (US)

( * ) Notice: Subject to any disclaimer, the term of this patent is extended or adjusted under 35 U.S.C. 154(b) by 31 days.

(21) Appl. No.: 11/125,821

(22) Filed: Feb. 16, 2005

(65) Prior Publication Data

US 2006/0185755 A1 Aug. 24, 2006

(51) Int. Cl.
*B65B 1/04* (2006.01)

(52) U.S. Cl. ..... 141/89; 141/90; 141/85; 141/91; 134/144; 134/152; 134/153; 134/170

(58) Field of Classification Search ..... 141/11, 141/85, 89–92; 134/144, 152, 153, 170
See application file for complete search history.

(56) References Cited

U.S. PATENT DOCUMENTS

| | | | | |
|---|---|---|---|---|
| 4,024,896 | A | 5/1977 | Ishioka et al. | 141/90 |
| 4,207,932 | A | 6/1980 | Gilmour | 141/90 |
| 4,353,398 | A | 10/1982 | Weiler et al. | 141/91 |
| 4,452,263 | A | 6/1984 | McClure | 134/45 |
| 4,989,392 | A | 2/1991 | Lindgren et al. | 53/167 |
| 4,989,649 | A | 2/1991 | Weiler et al. | 141/1 |
| 5,167,720 | A | 12/1992 | Diamond et al. | 134/25.4 |
| 5,223,217 | A | 6/1993 | Frizziero | 422/26 |
| 5,458,166 | A | 10/1995 | Kronseder | 141/89 |
| 5,941,290 | A | 8/1999 | Vaughn, Jr. | 141/90 |
| 6,014,994 | A | 1/2000 | Schmidt | 141/89 |
| 6,481,468 | B1 | 11/2002 | Taggart | 141/85 |
| 6,761,191 | B1 | 7/2004 | Rosen et al. | 141/91 |
| 6,786,249 | B1 | 9/2004 | Armbruster et al. | 141/92 |

*Primary Examiner*—Steven O. Douglas
(74) *Attorney, Agent, or Firm*—Gregory S. Bollis; James J. Sales; Renee J. Rymarz

(57) ABSTRACT

An automatic cleaning apparatus and/or method for periodically cleaning a filling machine during a filling cycle without the need for human interaction to initiate the cleaning process. In some embodiments, a controller automatically initiates a cleaning sequence at predetermined intervals. The predetermined intervals can be a time interval, such as every thirty minutes for example, or based upon filling characteristics, such as after a predetermined number of containers are filled or a predetermined amount of product has flowed through the filling machine. In some embodiments, the controller performs many operations during the cleaning process. For example, the controller can prevent containers from entering the filling machine and control the operation of a cleaning manifold. Upon completion of the cleaning operation, the controller waits a predetermined period while filing operations commence before automatically initiating the next cleaning operation.

20 Claims, 2 Drawing Sheets

CLEANING SYSTEM FOR A FILLING MACHINE

CLAIM OF FOREIGN PRIORITY BENEFITS

NONE.

BACKGROUND OF THE INVENTION

Filling machines are used in many different industries. One particular use of filling machines includes filling containers such as bottles, cartons, and the like with liquid foodstuff such as milk, juice, other beverages, ketchup and other condiments, and the like. Some filling machines have a plurality of nozzles, filler valves, or dispensing heads that align with the containers to be filled.

Due to hygiene and cleanliness demands, these nozzles and adjacent portions of the filling machine need to be cleaned periodically to prevent the risks of contamination of the food product. Conventional cleaning methods can be relatively labor intensive and time consuming. Accordingly, some conventional machines may be cleaned only when shutdown between shifts or in connection with a change in product. Furthermore, conventional cleaning methods also tend to be dependent upon human action to initiate cleaning. Accordingly, such methods are subject to error due to the need for human interaction to initiate the cleaning process.

SUMMARY OF THE INVENTION

The present invention relates to an automatic cleaning apparatus and/or method for periodically cleaning a filling machine during a filling cycle without the need for human interaction to initiate the cleaning process. In some embodiments, a controller automatically initiates a cleaning sequence at predetermined intervals. The predetermined intervals can be a time interval, such as every thirty minutes for example, or based upon filling characteristics, such as after a predetermined number of containers are filled or a predetermined amount of product has flowed through the filling machine. In specific applications, the present invention sanitizes the filling equipment.

In some embodiments, the controller performs many operations during the cleaning or sanitizing process. For example, the controller can prevent the flow of product through the nozzles and prevent containers from entering the filling machine or portions of the filling machine.

In some embodiments, the controller controls the operation of a cleaning manifold. The controller controls the flow of cleaning solution through the cleaning manifold. In some embodiments, the controller also controls the position of the manifold relative the nozzles. Specifically, the controller can control the position of the manifold between a non-cleaning position to a cleaning position.

Some embodiments of the present invention relate to a method of cleaning a filling machine. In one embodiment, the method includes providing a controller that periodically initiates a cleaning operation. Upon completion of the cleaning operation, the controller waits a predetermined period while filing operations commence. After the predetermined period, the controller again automatically initiates the cleaning operation.

One particular embodiment is directed toward an apparatus for automatically cleaning a filling device on a periodic basis where the filling device has a container infeed. The apparatus includes a spray manifold that is selectively movable between a first position that places portions of the spray manifold below portions of the filling device and second position where the spray manifold does not interfere with the filing operations of the filling device. The apparatus also includes a container stopping mechanism coupled to the container infeed to selectively control movement of containers into the filling device. Additionally, the apparatus includes a controller in communication with the spray manifold and the container stopping mechanism. The controller periodically automatically initiates a cleaning sequence, causing the container stopping mechanism to prevent containers from entering the filing device while the spray manifold is actuated by the controller to cause the spray manifold to move below a portion of the fill device.

One particular method of the invention relates to a method of cleaning a filling machine including one or more of the following steps: providing a controller that automatically initiates a periodic cleaning operation of the filling machine; automatically initiating a cleaning operation with the controller; causing a cleaning solution to contact and clean one or more portions of the filling machine through operation of the controller; stopping the cleaning operation with the controller once the one or more portions of the filling machine are clean; waiting a predetermined period; and automatically initiating a cleaning operation with the controller once the predetermined period has passed.

Another method of the invention relates to a method for automatically cleaning a filling device on a periodic basis under the control of a controller where the filling device is positioned adjacent a container conveyor. The method includes one or more of the following: initiating a temporary stoppage in filling operations and a cleaning operation with the controller; commencing filling operations with the filling machine in response to completion of the cleaning operation; sensing a characteristic with the controller while filling operations commence; and initiating the cleaning operation and a temporary stoppage in filling operations once the characteristic meets a predetermined value. The cleaning operation initiated by the controller includes communicating between the controller and a container stopping mechanism; stopping an infeed of containers into the filling machine in response to the communication between the controller and the container stopping mechanism; communicating between the controller and cleaning solution spray system; spraying cleaning solution from the spray system toward the filling device in response to communication between the controller and the cleaning solution spray system; sensing a first characteristic with the controller to determine when the first characteristic meets a first predetermined value; communicating additional information between the controller and the cleaning solution spray system once the first characteristic meets the first predetermined value; stopping the spray of cleaning solution in response to the communication of the additional information between the controller and the cleaning solution spray system; communicating additional information between the controller and the container stopping mechanism; and allowing containers to pass by the container stopping mechanism in response to the communication of additional information between the controller and the container stopping mechanism.

Further aspects of the present invention, together with the organization and operation thereof, will become apparent from the following detailed description of the invention when taken in conjunction with the accompanying drawings.

DETAILED DESCRIPTION

Figure 1:
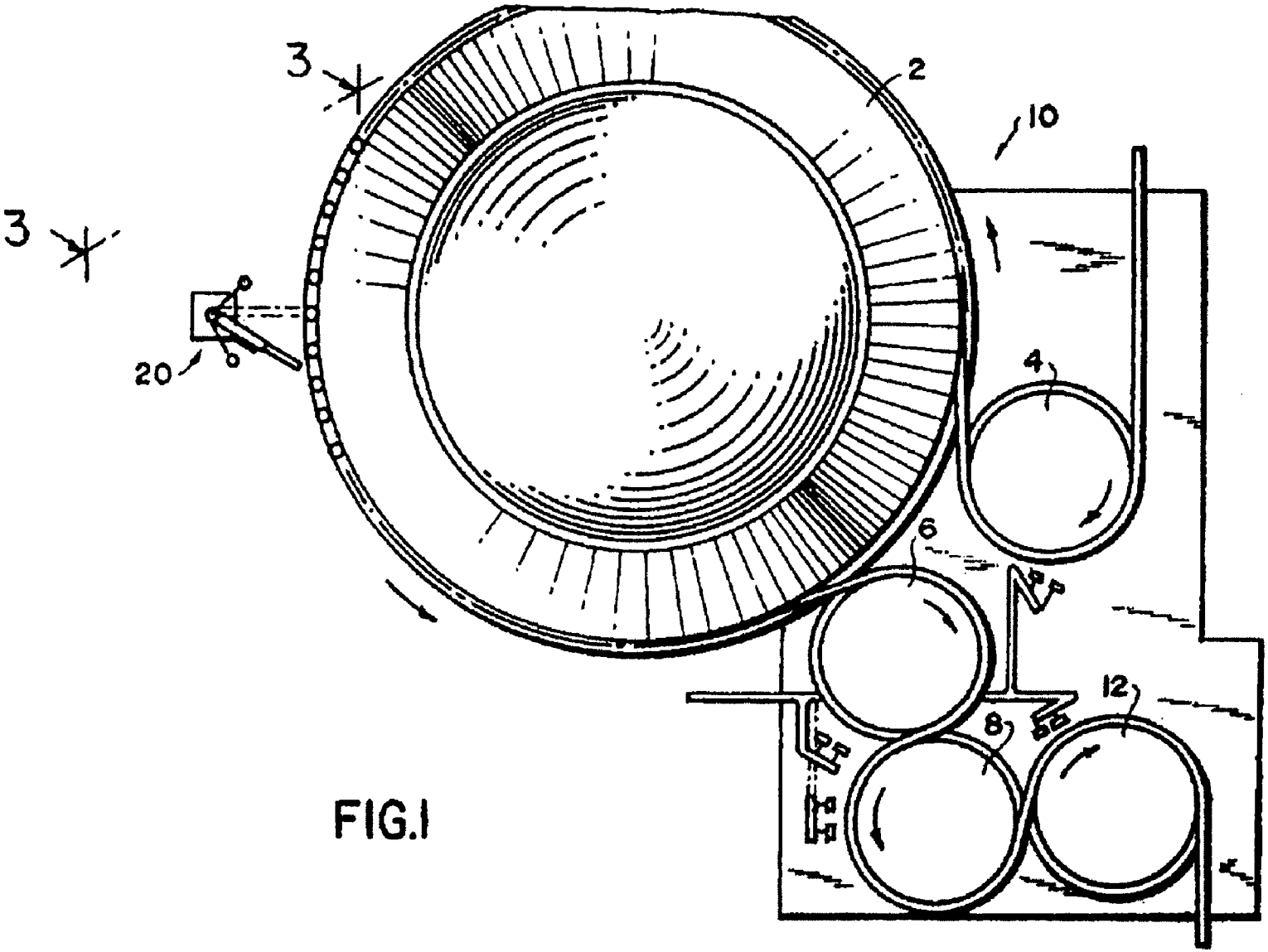
FIG. 1 is a schematic top plan view of a filling production line.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising," or "having" and variations thereof herein is meant to encompass the items listed thereafter and equivalents thereof as well as additional items. The terms "mounted," "connected," and "coupled" are used broadly and encompass both direct and indirect mounting, connecting and coupling. Further, "connected" and "coupled" are not restricted to physical or mechanical connections or couplings, and can include electrical connections or couplings, whether direct or indirect. Finally, as described in subsequent paragraphs, the specific mechanical configurations illustrated in the drawings are intended to exemplify embodiments of the invention. Accordingly, other alternative mechanical configurations are possible, and fall within the spirit and scope of the present invention.

The present invention relates to a cleaning apparatus and system for cleaning and/or sanitizing filling equipment, such as filling equipment used in industrial or institutional settings to fill containers with liquid or semi-liquid materials. For example, such equipment can be generally found in dairy, beverage, or brewery plants. However, as is known in the art, filling equipment can also be used for filling other liquid or semi-liquid materials.

Figure 2:
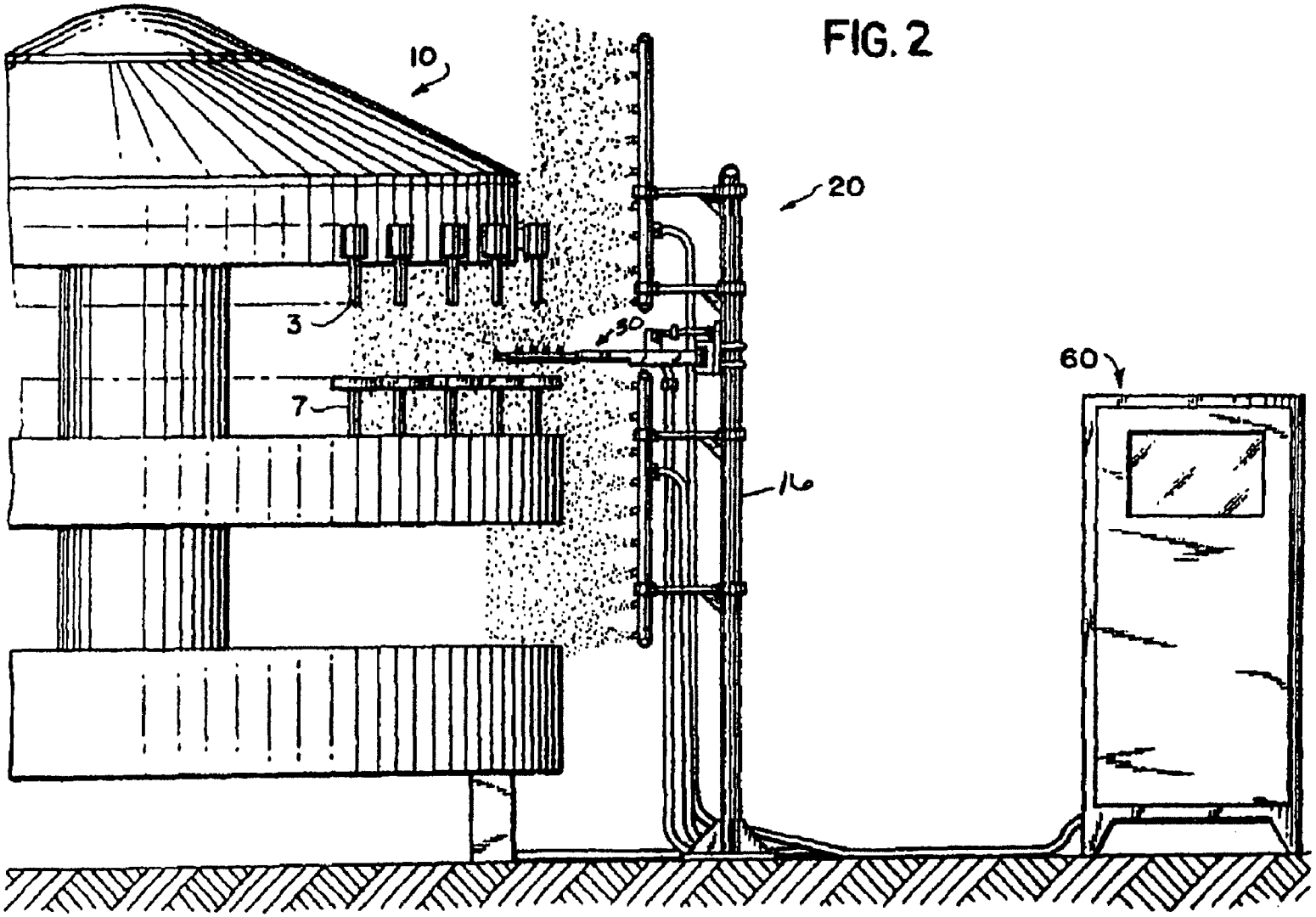
FIG. 2 is a side view of a filling machine embodying aspects of the present invention.

A conventional filling machine 10 used in a beverage or brewery plant is schematically illustrated in FIG. 1. In such a system, the containers to be filled travel along a continuous track or flow path through the use of one or more conveyors. As illustrated, the containers enter the filling machine 10 at an infeed station 4. From the infeed station 4, the containers move around a filler carousel 2. As illustrated in FIG. 2, a filler valve 3 is generally positioned above a plate 7 on the track. The containers rest on the plate 7 while traveling around the filler carousel 2. As the container travels around the filler carousel 2, the container is filled. Specifically, the containers are filled with the liquid or semi-liquid material dispensed from one or more filler valves 3. The containers then travel from the filler carousel 2 to the discharge star 6. The containers continue on the illustrated track to a capper or seamer station 8 to be sealed or closed. Once the container is sealed, the track passes out of the closure area to a capper or seamer discharge star wheel 12.

As the containers travel around the filler carousel 2, the contents to be filled may spill and overflow or the containers may break or tip. Accordingly, the filling station 10 can become soiled with the contents to be filled. As described above, if these spilled contents are not cleaned periodically, the filling machine can become contaminated.

Historically, cleaning the interior portion of the filler valve 3 or the area of the filler valve 3 facing radially toward the center of the filler carousel 2 has proven to be quite difficult. However, U.S. Pat. No. 5,941,290 discloses a manifold system particularly adapted at cleaning these portions of the filler valve 3. The teachings of this patent are hereby incorporated by reference. As shown in FIG. 2, this manifold system 20 has a movable spray arm assembly 30 that is mounted onto a vertical stanchion 16. The movable spray arm assembly 30 contains a plurality of nozzles 24 through which detergent active, a sanitizing agent, or the like may be sprayed.

As shown in FIGS. 1 and 2, the movable spray arm assembly 30 can be placed in multiple positions. As shown in FIG. 1, the spray arm assembly 30 can be placed in a storage position where the spray arm assembly 30 is moved or pivoted to a position that does not interfere with the filling operation. Specifically, in this position, the arm 30 is located outside the perimeter of the filler valves 3. Accordingly, containers can pass through the filling machine without interference from the arm 30. However, as shown in phantom in FIG. 1, the arm can be pivoted to a second position where all sides of the filler valve 3 can be properly cleaned by the arm 30. In this position, the movable spray arm assembly 30 can be positioned with the nozzles 24 directed upward toward the filler valve 3, as shown in FIG. 2, to clean and/or sanitize the valve 3.

It should be understood that the spray arm assembly 30 can be move by substantially any means known in the art. For example, pneumatics, hydraulics, electronic actuators, mechanical actuators and the like can be used.

The present invention uses a controller 60 such as a programmable logic controller (PLC) to automatically control the operation of the cleaning system. The controller 60 can be located within the control panel of the filling machine or it can be located in other areas. For example, in some embodiments, the controller 60 can be the controller of the filling machine. The controller 60 can be placed in communication with one or more components of the filling machine, the conveying system, and the cleaning assembly 20.

The controller 60 automatically initiates a cleaning operation on a periodic basis without the need for human interaction. In other words, an operator does not need to initiate the cleaning operation nor perform any manual operations during the cleaning operation to effectuate the cleaning operation. The controller 60 automatically initiates a cleaning sequence at predetermined intervals. The predetermined intervals can be a time interval, such as every thirty minutes for example. Alternatively, the intervals can be based upon filling characteristics. For example, the controller can automatically initiate a cleaning operation after a predetermined number of containers are filled or after a predetermined amount of product has flowed through the filling machine. In one particular filling operation, it was discovered that the cleanliness of a dairy filling operation can be optimized by cleaning the filler valves about every thirty minutes.

In one exemplary embodiment, the controller 60 controls the operation of the container infeed, the movable spray arm 30, the filler valves 3, and supply of cleaning solution during a cleaning operation. The controller 60 communicates with these devices either directly or indirectly to cause one or more actions to occur.

Upon actuation of the cleaning operation, the controller prevents containers from moving onto the filler carousel 2. Since containers are prevented from entering the filler carousel 2, product to be filled is prevented from flowing from filler valves 3. The spray arm assembly 30 is then moved once the spray arm assembly 30 can be moved at least partially under the filler carousel 2 without interfering with the remaining containers on the filler carousel 2. Additionally, cleaning solution can also begin to flow from the nozzles on the spray arm 30.

The flow of cleaning solution from the spray arm 30 can continue until the filler valves are sufficiently clean. This can be experimentally determined depending upon the product being filled and other environmental considerations. The controller can stop the flow of cleaning solution when a condition or characteristic is sensed that indicates that the filler valves 3 should be clean. The characteristic can be time, the number of revolutions of the filling machine, amount of cleaning solution dispensed, and the like. Once this sensed characteristic meets a predetermined value for the characteristic (i.e., a preset time, number of revolutions, solution dispensed, or the like), the flow of cleaning solution can be stopped. In other words, the controller 60 can communicate with the spray arm assembly 30 to stop the flow cleaning solution.

Once the filler valves are properly cleaned, the steps outlined above can be reversed. In other words, the controller 60 can stop the supply of cleaning solution to the movable arm 30 and move the spray arm to the storage or filling position. The controller 60 communicates with the other devices described above to allow containers to pass from the infeed area to the filling area, which will then allow product to be dispensed.

A variety of mechanisms can be used to stop the infeed of containers to the filling machine. For example, the operation of the infeed station 4 can be suspended by communications from the controller 60. Alternatively, the controller 60 can cause an arm to be positioned in the container flow path to prevent containers from entering the filling machine. These and other devices and techniques known in the art can be utilized by the controller 60 to prevent containers from flowing into the filling machine.

Once filling operations commence, the controller 60 can sense another characteristic to determine when to initiate the next cleaning operation. The controller 60 can sense time, the amount of product dispensed, rotations of the filling machine, containers filled, and the like. Once the sensed characteristic meets a predetermined value for the characteristic, filling operations can be temporarily suspended by the controller 60 while the cleaning operations occur.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention. For example, a rotary type filling machine is shown and described herein. However, in other embodiments, other types of filling machines can be used, such as linear filling machines for example. Additionally, other cleaning mechanisms other than the illustrated cleaning mechanism can be used.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

Various features of the invention are set forth in the following claims.

What is claimed is:

1. An apparatus for automatically cleaning a filling device on a periodic basis where the filling device has a container infeed, the apparatus comprising:

a spray manifold that is selectively movable between a first position placing portions of the spray manifold below portions of the filling device and a second position where the spray manifold does not interfere with the filing operations of the filling device;

a container stopping mechanism coupled to the container infeed to selectively control movement of containers into the filling device; and a controller in communication with the spray manifold and the container stopping mechanism, the controller periodically automatically initiating a cleaning sequence causing the container stopping mechanism to prevent containers from entering the filing device while the spray manifold is actuated by the controller to cause the spray manifold to move below a portion of the fill device.

2. The apparatus of claim 1, wherein the container stopping mechanism comprises a stopping device on an infeed station.

3. The apparatus of claim 1, wherein the container stopping mechanism comprises an actuatable arm that is movable into a flow path of the containers.

4. The apparatus of claim 1, wherein the controller is a programmable logic controller.

5. The apparatus of claim 1, wherein the controller initiates the cleaning sequence on a time interval.

6. The apparatus of claim 1, wherein the controller initiates the cleaning sequence on a periodic basis dependent upon flow characteristics of the filling device.

7. The apparatus of claim 6, where the flow characteristics include the amount of product dispensed.

8. The apparatus of claim 6, where the flow characteristics include the number of containers filled.

9. A method of cleaning a filling machine comprising:

providing a controller that automatically initiates a periodic cleaning operation of the filling machine;

automatically initiating a cleaning operation with the controller;

causing a cleaning solution to contact and clean one or more portions of the filling machine through operation of the controller;

stopping the cleaning operation with the controller once the one or more portions of the filling machine are clean;

waiting a predetermined period; and automatically initiating a cleaning operation with the controller once the predetermined period has passed.

10. The method of claim 9, further comprising actuating a spray manifold with the controller to move a portion of the spray manifold to a position at least partially beneath a portion of the filling machine after the cleaning operation is initiated.

11. The method of claim 10, further comprising retracting the spray manifold to its previous position.

12. The method of claim 10, further comprising stopping an infeed of containers into the filling machine prior to causing the cleaning solution to contact the filling machine.

13. The method of claim 9, further comprising stopping an infeed of containers into the filling machine prior to causing the cleaning solution to contact the filling machine.

14. The method of claim 13, wherein stopping the infeed of containers comprises obstructing the flow of containers into the filling machine.

15. The method of claim 14, wherein obstructing the flow of containers includes actuating a rod into a flow path of the containers.

16. A method for automatically cleaning a filling device on a periodic basis with a controller, the method comprising:

initiating a cleaning operation and a temporary stoppage in filling operations with the controller, the cleaning operation initiated by the controller including the following:

communicating between the controller and a container stopping mechanism;

stopping an infeed of containers into the filling machine in response to the communication between the controller and the container stopping mechanism;

communicating between the controller and cleaning solution spray system;

spraying cleaning solution from the spray system toward the filling device in response to communication between the controller and the cleaning solution spray system;

sensing a first characteristic with the controller to determine when the first characteristic meets a first predetermined value;

communicating additional information between the controller and the cleaning solution spray system once the first characteristic meets the first predetermined value;

stopping the spray of cleaning solution in response to the communication of the additional information between the controller and the cleaning solution spray system;

communicating additional information between the controller and the container stopping mechanism; and allowing containers to pass by the container stopping mechanism in response to the communication of additional information between the controller and the container stopping mechanism;

commencing filling operations with the filling machine in response to containers passing by the container stopping mechanism;

sensing a second characteristic with the controller while filling operations commence; and initiating the cleaning operation and a temporary stoppage in filling operations once the second characteristic meets a second predetermined value.

17. The method of claim 16 further comprising moving a portion of the spray system to a position located under filling valves of the filling machine in response to communication between the controller and the cleaning solution spray system.

18. The method of claim 17, further comprising moving the portion of the spray system to a position not located under the filling valves of the filling machine in response to the communication of the additional information between the controller and the cleaning solution spray system.

19. The method of claim 16, wherein the first characteristic is time and the first predetermined value is a predetermined time.

20. The method of claim 16, wherein the second characteristic is time and the second predetermined value is a second predetermined time.

* * * * *